US005399065A

United States Patent [19]

Kudo et al.

[11] Patent Number: 5,399,065

[45] Date of Patent: Mar. 21, 1995

[54] IMPROVEMENTS IN COOLING AND SEALING FOR A GAS TURBINE CASCADE DEVICE

[75] Inventors: Takeshi Kudo; Isao Takehara; Tetsuo Sasada; Shunichi Anzai, all of Hitachi; Kazuhiko Kawaike, Katsuta, all of Japan

[73] Assignee: Hitachi, Ltd., Japan

[21] Appl. No.: 114,074

[22] Filed: Aug. 31, 1993

[30] Foreign Application Priority Data

Sep. 3, 1992 [JP] Japan ..... 4-235606

[51] Int. Cl.[6] ..... F01D 9/02; F01D 5/18

[52] U.S. Cl. ..... 415/115; 415/116

[58] Field of Search ..... 415/115, 116, 173.7, 415/208.2

[56] References Cited

U.S. PATENT DOCUMENTS 3,275,294 9/1966 Allen et al. ..... 415/115 X
3,540,810 11/1970 Kercher ..... 415/115 X
3,551,068 12/1970 Scalzo et al. ..... 415/116 X
4,869,640 9/1989 Schwarz et al. ..... 415/116
5,207,556 5/1993 Frederick et al. ..... 415/116
5,253,976 10/1993 Cunha ..... 415/115

FOREIGN PATENT DOCUMENTS 2-241902 9/1990 Japan .

*Primary Examiner*—John T. Kwon
*Assistant Examiner*—Michael S. Lee
*Attorney, Agent, or Firm*—Fay, Sharpe, Beall, Fagan, Minnich & McKee

[57] ABSTRACT

In a cascade device for a gas turbine, cooling air which has passed through a trailing air cooling chamber of each stationary blade is discharged from a tip of the stationary blade toward a side surface of a base of a moving blade disposed adjacent to the stationary blade. With this arrangement, the cooling of the stationary blade as well as the sealing of a cascade portion is effected satisfactorily with a smaller amount of the air.

4 Claims, 6 Drawing Sheets

IMPROVEMENTS IN COOLING AND SEALING FOR A GAS TURBINE CASCADE DEVICE

BACKGROUND OF THE INVENTION

This invention relates generally to improvements in a cascade device for a gas turbine, and more particularly to an improved cascade device having air cooling chambers provided respectively within leading and trailing edge portions of each stationary blade.

Recently, in order to enhance the performance of a gas turbine, the temperature of combustion gas has been raised more and more, so that stationary blades and moving blades of the gas turbine operate in a very thermally severe environment.

Therefore, these blades must be cooled by some cooling means.

Generally, for cooling turbine blades, there has been extensively used a method in which part of the compressed air for combustion purposes is taken out, and is caused to flow through a cavity (air cooling chamber) within the blade to cool the blade.

A typical example of such a cooling method is disclosed, for example, in Japanese Patent Unexamined Publication No. 2-241902, in which a cooling chamber (or flow passage) is provided within a trailing edge portion of a blade, and projections or pin-like members are provided within this cooling chamber so as to achieve a good heat exchange. With respect to cooling air serving as a cooling medium, the cooling air which has cooled the cooling chamber in the central portion or the leading edge portion of the stationary blade is led to the trailing edge portion of the stationary blade, or the cooling air is led directly to the cooling chamber in the trailing edge portion of the stationary blade, thereby cooling this trailing edge portion, and then the air raised to a high temperature is discharged from the trailing edge portion, thus cooling the blade.

On the other hand, the air taken out from the compressed air for combustion purposes is further used as sealing air. More specifically, a gap or clearance is formed between the stationary blade and the moving blade in order to prevent overshoot. Because of the provision of this gap at this portion, the leakage of the high-temperature gas naturally develops there, and therefore it is necessary to seal this portion. The air taken out from the air for combustion purposes is used to seal this portion. Generally, this sealing air is fed from an outlet of a compressor into a rotor, and fills in the gap at the cascade portion with a certain pressure.

In the cascade device of this construction, the trailing edge portion of the stationary blade is cooled by the air which has been supplied into the stationary blade to cool the inner wall of the stationary blade through impingement cooling or convection cooling; therefore, the temperature of the air is raised, and the pressure of the air is decreased. This results in a tendency that the trailing edge portion of the stationary blade fails to be sufficiently cooled. In the other method in which the cooling air is led directly to the trailing edge portion of the blade, the trailing edge portion can be cooled to a certain degree; however, since the air raised to a high temperature as a result of the cooling is discharged from the trailing edge of the blade to a main-stream operating gas passage, the velocity of the cooling air flowing through the cooling chamber is determined by the pressure difference between the pressure within the cooling chamber and the outlet pressure (i.e., the pressure at the outlet of the trailing edge portion of the blade), and therefore the velocity of the cooling air tends to become uneven. Namely, in the turbine blade, the pressure distribution in the radial direction of the main flow (stream) passage is not uniform because of a centrifugal action caused by the flow of the high-temperature operating gas. Namely, the pressure of the blade surface is high at the outer peripheral portion, and is low at the inner peripheral portion. Therefore, with the type of cooling construction in which the air is blown from the cooling flow passage to the trailing edge portion of the blade, the velocity of the cooling air flowing through the cooling chamber is uneven.

Incidentally, it is well known that the cooling characteristics of the cooling air become good in proportion to the velocity. Namely, the unevenness of the velocity causes the unevenness of the cooling characteristics, which results in a disadvantage that the temperature of the blade becomes high at the outer peripheral portion, and is low at the inner peripheral portion, so that a temperature difference develops at the surface and the inside of the blade in the direction of the height of the blade. Furthermore, when blowing the cooling air from the trailing edge portion of the blade, the high-temperature operating gas of high velocity is mixed with the low-temperature cooling air of low velocity, so that a so-called mixture loss develops. This results in a problem that the aerodynamic performance is degraded.

A more serious problem is that a large amount of compressed air is used as this cooling air and the sealing air, so that the air for the combustion is not secured in a sufficient amount, which results in a lower output of the gas turbine.

SUMMARY OF THE INVENTION

With the above problems in view, it is an object of this invention to provide a cascade device for a gas turbine by which the cooling of each stationary blade, as well as the sealing of a cascade portion, is effected satisfactorily with a smaller amount of the air.

According to one aspect of the present invention, there is provided a cascade device for a gas turbine comprising:

- stationary blades each having a leading air cooling chamber and a trailing air cooling chamber which are provided respectively within a leading edge portion and a trailing edge portion of the stationary blade; and
- means for discharging cooling air, which has passed through the trailing air cooling chamber, from a tip of the stationary blade toward a side surface of a base of a moving blade disposed adjacent to the stationary blade.

The discharging means may discharge cooling air, which has passed through the trailing air cooling chamber, from the tip of the stationary blade to a space between the tip of the stationary blade and the base of the moving blade disposed adjacent to the stationary blade.

The discharging means may include means for injecting the cooling air from the tip of the stationary blade to the space between the tip of the stationary blade and the base of the moving blade disposed adjacent to the stationary blade.

The cascade device may include means for leading the cooling air to be supplied to the stationary blade directly to the trailing air cooling chamber.

The cascade device may further include means for discharging cooling air, which has passed through the leading air cooling chamber, to a space between the tip of the stationary blade and the base of the moving blade disposed adjacent to an upstream side of the stationary blade.

According to another aspect of the invention, there is provided a cascade device for a gas turbine comprising:

stationary blades each having a leading air cooling chamber and a trailing air cooling chamber which are provided respectively within a leading edge portion and a trailing edge portion of the stationary blade; and an air sealing device provided between a tip of the stationary blade and a base of a moving blade disposed adjacent to the stationary blade, the air sealing device utilizing as sealing air the cooling air which has passed through the trailing air cooling chamber.

The air sealing device may be provided between the stationary blade and the moving blade disposed adjacent to the stationary blade, and the air raised to a high temperature within the trailing air cooling chamber may be used as sealing air to be supplied to the air sealing device.

According to a further aspect of the invention, there is provided a gas turbine comprising:

stationary blades each having a trailing air cooling chamber provided within a trailing edge portion of the stationary blade; and means for supplying sealing air to a space between the stationary blade and a moving blade disposed adjacent to the stationary blade, the air raised to a high temperature within the trailing air cooling chamber being used as sealing air to be supplied to the space between the stationary blade and the moving blade.

According to a still further aspect of the invention, there is provided a gas turbine comprising:

stationary blades each having an air cooling chamber provided within the stationary blade; and means for supplying sealing air to a space between the stationary blade and a moving blade disposed adjacent to the stationary blade;

wherein cooling air passed through that portion of the air cooling chamber disposed at a trailing edge portion of the stationary blade is discharged to a space between a tip of the stationary blade and a base of the moving blade to be mixed with the sealing air.

With the cascade construction for a gas turbine according to the invention, the cooling air, raised to a high temperature as a result of the cooling, is discharged or injected from the tip of the stationary blade toward the side surface of the base of the moving blade disposed adjacent to the stationary blade. Therefore, the discharged air and the main-stream operating gas will not interfere with each other, and the cooling of the stationary blade as well as the sealing of the cascade portion can be effected with generally the same amount of the cooling air as used in the conventional constructions. Particularly, the cooling air raised to a high temperature has been increased in volume, and therefore a satisfactory sealing operation, as obtained with the use of a sufficient amount of the air, can be effected with a smaller amount of the air.

DESCRIPTION OF THE PREFERRED EMBODIMENTS

A preferred embodiment of the present invention will now be described with reference to the drawings.

Figure 1:
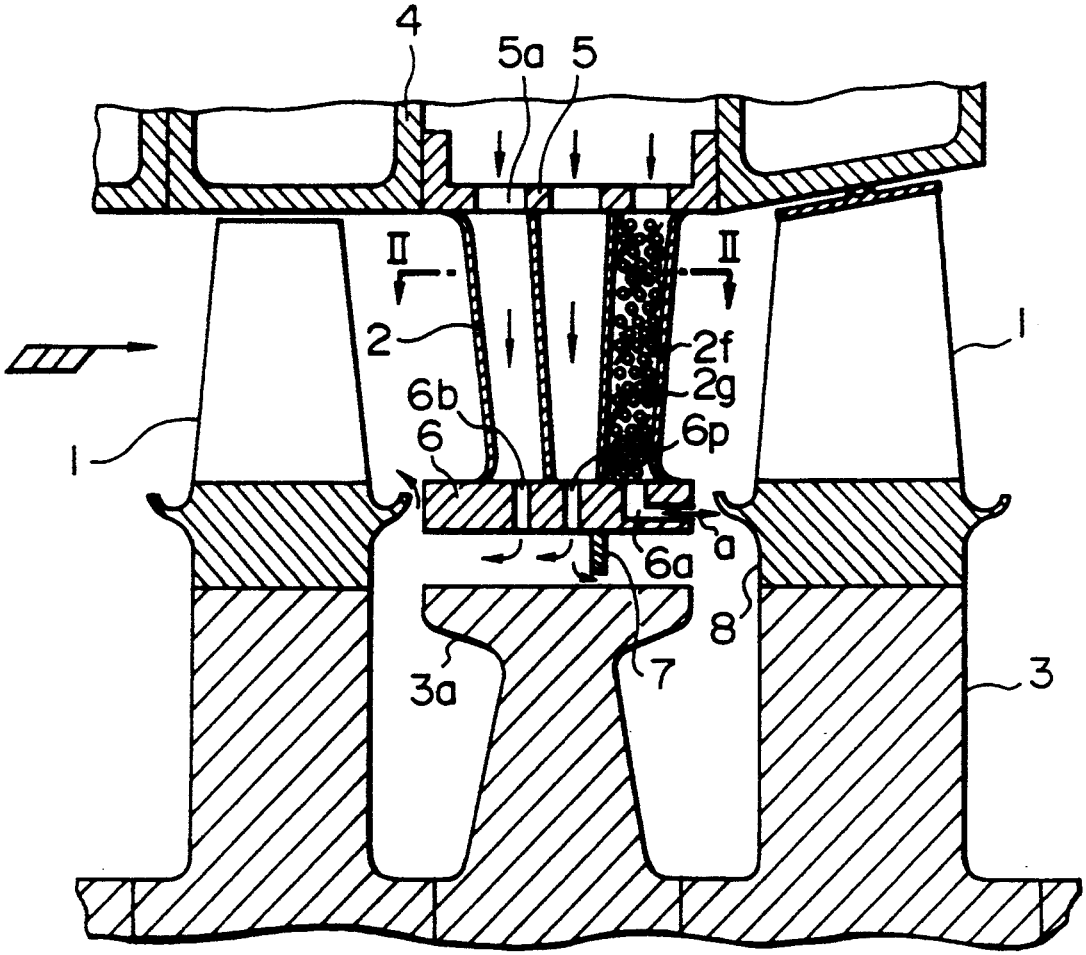
FIG. 1 is a longitudinal cross-sectional view of a first embodiment of the present invention, showing a cascade portion.
Figure 2:
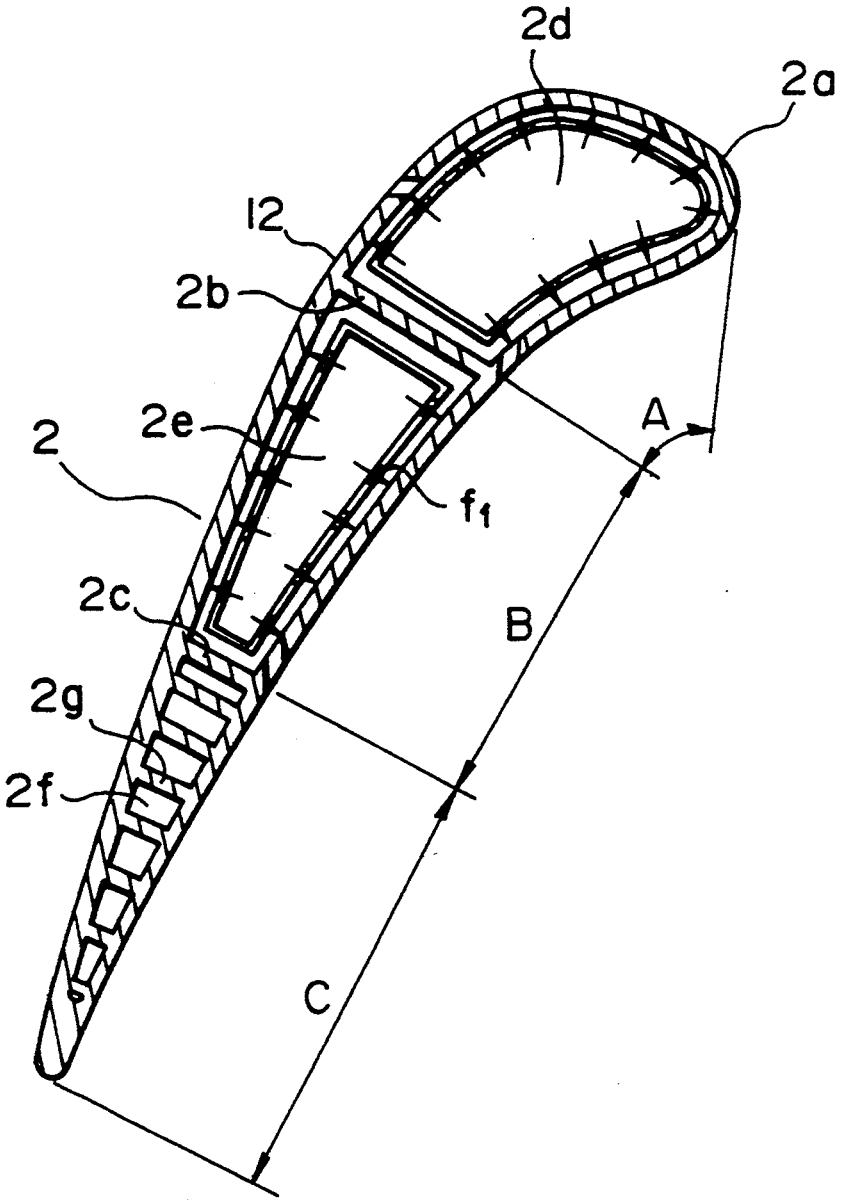
FIG. 2 is a cross-sectional view taken along the line II—II of FIG. 1.
Figure 8:
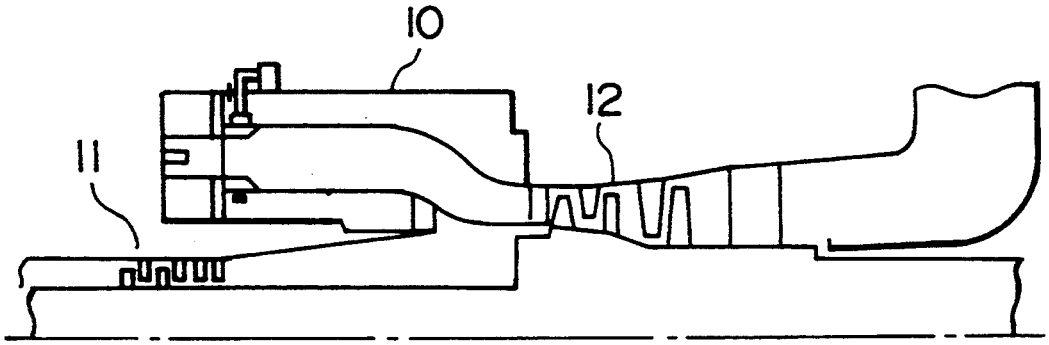
FIG. 8 is a schematic view showing a general construction of a gas turbine to which the present invention can be applied.

FIG. 8 schematically shows a gas turbine which comprises a combustor 10, a compressor 11 and a cascade device 12. The cascade device 12 comprises stationary blades and moving blades which are arranged in juxtaposed relation. FIG. 1 shows a cascade portion, and shows a longitudinal cross-section of the stationary blade. FIG. 2 shows a transverse cross-section of the stationary blade.

Referring to FIG. 1, the moving blades 1 are fixedly mounted on a rotor (rotary member) 3, and the stationary blades 2 are fixedly mounted on a casing (fixed member) 4. In FIG. 1, arrows without a feather indicate the flow of cooling air and sealing air, and an arrow with a feather indicates the flow of high-temperature gas (mainstream operating gas).

As can be clearly seen from FIG. 2, the stationary blade 2 is divided by a shell **2*a* and partition walls 2*b* and 2*c* into three cavities, that is, air cooling chambers 2*d*, 2*e* and 2*f*. In this case, a leading portion A and a central portion B of the blade are cooled by impingement jets f1. This cooling may be effected by any other suitable cooling means such as convection cooling. A trailing edge portion C of the blade 2 has the air cooling chamber 2*f* isolated from the air cooling chamber 2*e* of the central portion B by the partition wall 2*c*, and pin fins 2*g* for fin cooling are provided within the air cooling chamber 2*f***. This cooling construction may also be of any other suitable type such as convection cooling.

Referring again to FIG. 1, the stationary blade 2 is interposed between and fixedly secured to an outer peripheral wall 5 and an inner peripheral wall 6. A partition wall 7 is mounted on the inner peripheral wall 6, and is disposed in a gap between this inner peripheral wall 6 and the rotor 3. The partition plate 7 separates an upstream side from a downstream side. Cooling air is supplied from the cooling air supply source, that is, the compressor 11 (FIG. 8), into the air cooling chambers **2*d*, 2*e* and 2*f* within the blade 2 through cooling air inlet ports 5*a* formed in the outer peripheral wall 5. After effecting the cooling, the cooling air in the air cooling chamber 2d and the cooling air in the air cooling chamber 2e are discharged respectively through discharge ports 6b and 6p formed in the inner peripheral wall 6. After effecting the cooling, the cooling air in the air cooling chamber 2f is discharged from a discharge port 6a which is formed in the inner peripheral wall 6 and is open to a downstream side. Particularly, the cooling air is discharged from the air cooling chamber 2f in the following manner. Namely, the cooling air is discharged from the downstream side of the inner peripheral wall 6 adjacent to the tip of the stationary blade 2 to a space between the tip of the stationary blade 2 and a base 8 of the moving blade 1 disposed adjacent to the downstream side of the stationary blade 2**.

The cooling air, which has passed through the leading air cooling chamber 2d, is discharged to a space between the tip of the stationary blade 2 and the base 8 of the moving blade 1 disposed adjacent to an upstream side of the stationary blade.

With the cascade device of this construction, the cooling air which has cooled the trailing edge portion of the stationary blade 2 will not be discharged to the surface of the blade, and therefore will not undergo an influence of the pressure distribution on the blade surface, so that the blade can be cooled generally uniformly over the entire area thereof in an optimal manner.

With this construction, the air, which has been discharged from the blade 2 through the discharge port 6a, further serves as sealing air a between the inner peripheral wall (stationary member) 6 and the rotor 3. With this arrangement, the amount of leakage of the air through a gap between the partition plate 7 and a convex portion 3a of the rotor 3 is reduced. Since the air which has contributed to the cooling of the stationary blade 2 is thus utilized as the sealing air, the total amount of the air used for sealing purposes in the gas turbine is reduced, so that the amount of the air contributing to the combustion is increased relatively. This enhances the efficiency of the turbine.

Figure 3:
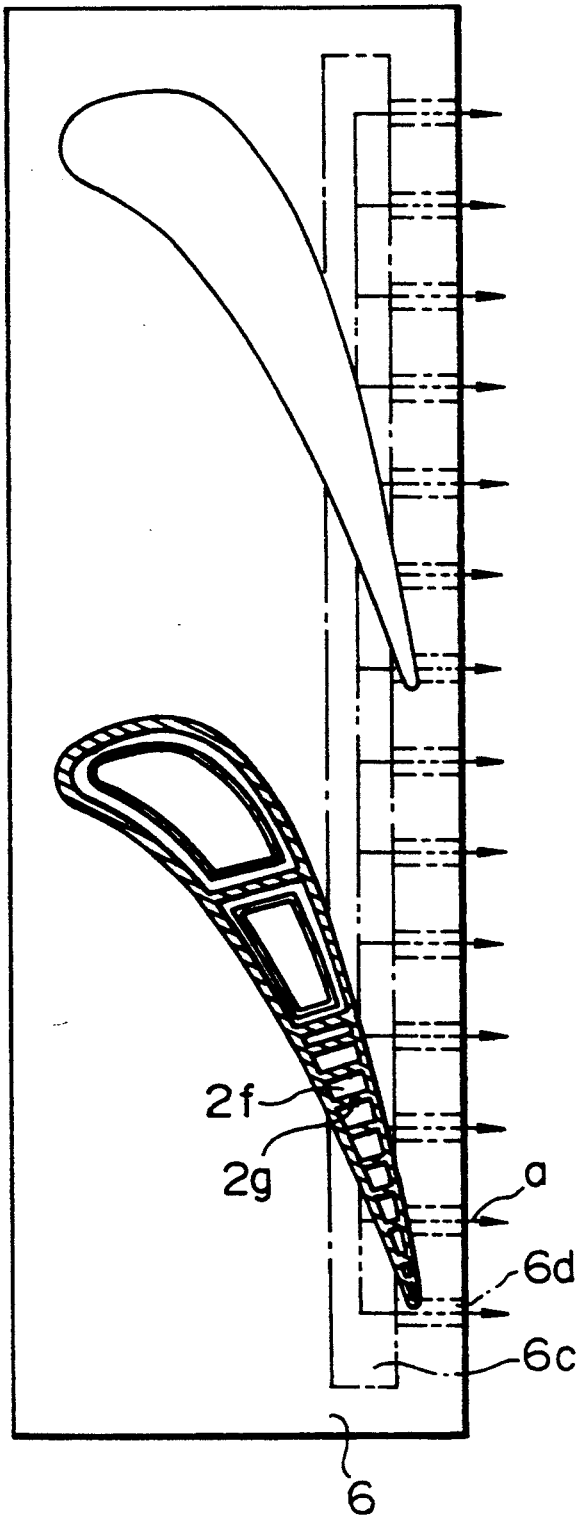
FIG. 3 is a development view of an important portion of a second embodiment of the invention, showing an inner peripheral wall including a stationary blade.

In the above description, when discharging the air from the tip of the stationary blade 2, the air is discharged only from that portion (in the peripheral direction) where the stationary blade 2 is located; however, preferably, this air discharge should be effected equally over the entire periphery, and one such example is illustrated in FIG. 3 which shows the stationary blade in horizontal section. A peripheral hole 6c is formed in the inner peripheral wall 6 and extends in the direction of the periphery of this wall 6, the peripheral hole 6c communicating with the air cooling chamber 2f of the stationary blade 2. A plurality of air discharge ports 6d are formed in the inner peripheral wall 6, extend axially from the peripheral hole 6c, and are spaced at predetermined intervals in the direction of the periphery of the inner peripheral wall 6. With this arrangement, by suitably determining the interval between the air discharge ports 6d, the sealing air can be fed generally uniformly over the entire periphery.

Figure 4:
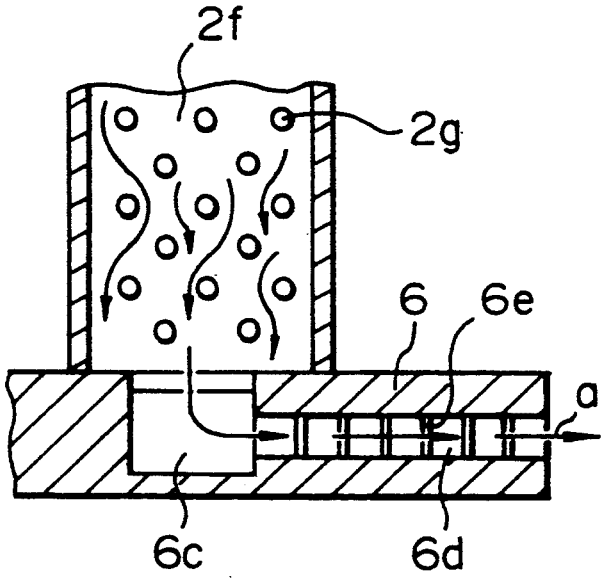
FIG. 4 is a cross-sectional view of a modified form of the second embodiment, showing an inner peripheral wall and a proximal end portion of a stationary blade.
Figure 5:
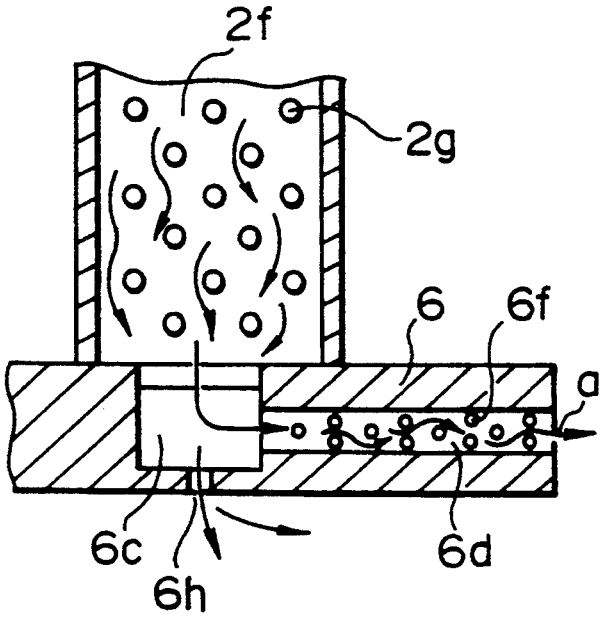
FIG. 5 is a view similar to FIG. 4, but showing another modified form of the second embodiment.

FIGS. 4 and 5 show modifications of the air discharge port 6d of FIG. 3, respectively. In these examples, fins 6e or pin-like members 6f are provided in the air discharge port 6d to cool the inner peripheral wall 6. In this case, as shown in FIG. 5, a discharge control hole 6h for controlling the amount of discharge of the discharge air a may be formed in the inner peripheral wall 6 to balance the pressure of the sealing air in a space inside the inner peripheral wall 6.

Figure 6:
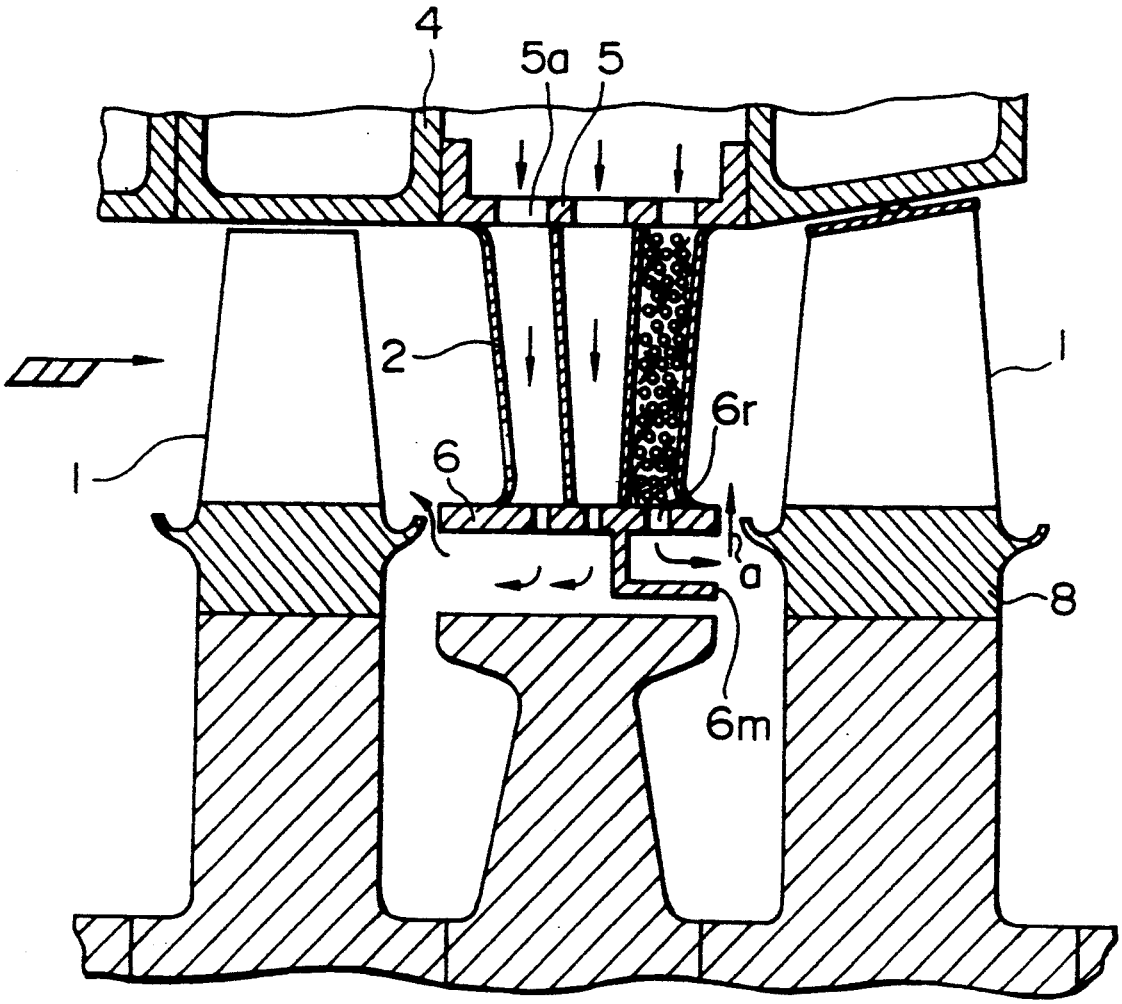
FIG. 6 is a longitudinal cross-sectional view of a third embodiment of the present invention, showing a cascade portion.

In the above description, although the discharge port 6a and the discharge ports 6d are provided in the inner peripheral wall 6, for discharging the air from the tip of the stationary blade 2 toward the side surface of the moving blade 1, this is not always necessary, and instead the following arrangement may be adopted. Namely, as shown in FIG. 6, a hole or port 6r is formed radially through the inner peripheral wall 6, and a guide wall 6m is provided inwardly of the through hole 6r in an opposed relation with the port 6r so as to guide the discharge air so that the discharge air can be discharged or injected toward the moving blade 1. The guide wall 6m is fixedly mounted on or formed integrally with the inner peripheral wall 6, and has a portion disposed in opposed relation to the through hole 6r. The guide wall 6m and the base 8 of the moving blade 1 are made of a heat-resistant material capable of withstanding the temperature of the air discharged from the through hole 6r. With this construction, advantageously, the inner peripheral wall 6 does not need to be much increased in thickness. Furthermore, it is possible that the air is discharged toward a desired point on the side surface of the moving blade 1.

Figure 7:
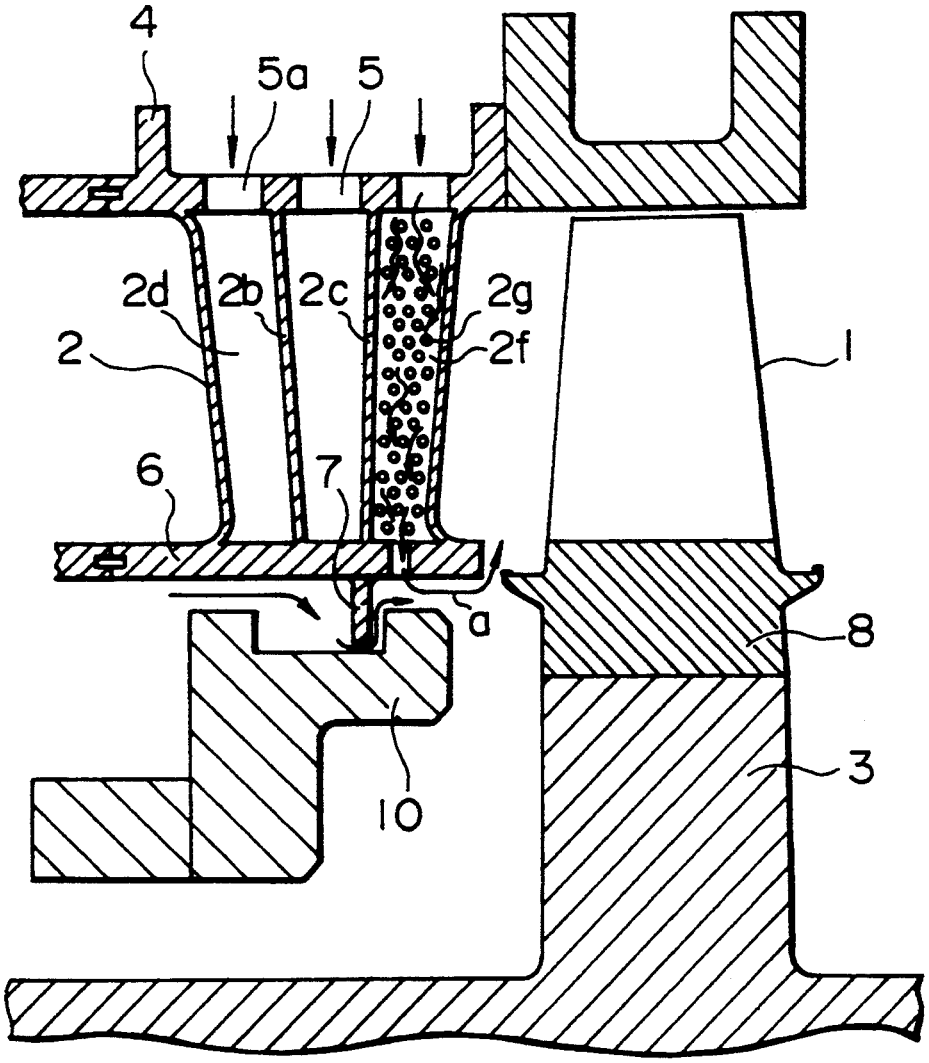
FIG. 7 is a longitudinal cross-sectional view of a fourth embodiment of the present invention, showing a cascade portion.

FIG. 7 shows an example in which the invention is applied to a modified cascade portion. In this case, a stationary member 10 is disposed inwardly of a stationary blade 2, and an outer end of the stationary member 10 is used as a guide wall for guiding the discharge air. With this arrangement, an additional air guide device is not needed, and advantageously the construction can be simplified.

In the above embodiments, the cooling air which has passed through the leading air cooling chamber 2d may be discharged to a space between the stationary blade 2 and the base 8 of the moving blade 1 disposed on the upstream side of the stationary blade 2.

As described above, in the present invention, the cooling air, which has passed through the air cooling chamber at the trailing edge portion of the stationary blade, is discharged from the tip of the stationary blade toward the side surface of the base of the moving blade disposed adjacent to the stationary blade. Therefore, the discharged air and the main-stream operating gas will not interfere with each other, and besides the cooling air which has been raised to a high temperature has been increased in volume, and therefore a satisfactory sealing operation, as obtained with the use of a sufficient amount of the air, can be effected with a smaller amount of the air. Therefore, the cooling of the stationary blade as well as the sealing of the cascade portion is effected satisfactorily with a smaller amount of the air.

What is claimed is:

1. A cascade device for a gas turbine comprising:

stationary blades each having a leading air cooling chamber and a trailing air cooling chamber which are provided respectively within a leading edge portion and a trailing edge portion of said stationary blade;

first means for discharging cooling air, which has passed through said trailing air cooling chamber, from a tip of said stationary blade to a space between the tip of said stationary blade and a base of a moving blade disposed adjacent to said stationary blade; and means for leading the cooling air to be supplied to said stationary blade directly to said trailing air cooling chamber, wherein said first discharging means discharges the cooling air, which has passed through said trailing air cooling chamber, to a space between the tip of said stationary blade and the base of the moving blade disposed adjacent to a downstream side of said stationary blade; and second means for discharging cooling air, which has passed through said leading air cooling chamber, to a space between the tip of said stationary blade and a base of a moving blade disposed adjacent to an upstream side of said stationary blade.

2. A cascade device for a gas turbine comprising:

stationary blades each having a leading air cooling chamber and a trailing air cooling chamber which are provided respectively within a leading edge portion and a trailing edge portion of said stationary blade; and means for discharging cooling air, which has passed through said trailing air cooling chamber, from a tip of said stationary blade toward a side surface of a base of a moving blade disposed adjacent to said stationary blade;

wherein said discharging means comprises an air discharge port which is provided at the tip of said stationary blade, communicates with said trailing air cooling chamber, and extends in a radial direction, and a guide device provided in opposed relation to said air discharge port for guiding the air, discharged from said air discharge port, toward the side surface of the base of the moving blade disposed adjacent to said stationary blade.

3. A cascade device according to claim 2, in which said guide device is formed integrally with said stationary blade at the tip of said stationary blade.

4. A cascade device according to claim 2, in which said guide device and the base of the moving blade are made of a heat-resistant material capable of withstanding the temperature of the air discharge from said air discharge port provided at the tip of said stationary blade.

* * * * *